US005129592A

United States Patent [19]

Wey

[11] Patent Number: 5,129,592

[45] Date of Patent: Jul. 14, 1992

[54] METHOD AND APPARATUS FOR TRANSPORTING GROUPS OF PACKAGES FROM WINDING STATIONS OF A TEXTILE MACHINE TO A FURTHER HANDLING LOCATION

[75] Inventor: Edmund Wey, Nettetal, Fed. Rep. of Germany

[73] Assignee: W. Schlafhorst & Co., Moenchengladbach, Fed. Rep. of Germany

[21] Appl. No.: 582,133

[22] Filed: Sep. 12, 1990

Related U.S. Application Data

[63] Continuation-in-part of Ser. No. 330,626, Mar. 30, 1989, abandoned.

[30] Foreign Application Priority Data

Mar. 30, 1988 [DE] Fed. Rep. of Germany ..... 3810772

[51] Int. Cl.[5] ..... B65H 67/06

[52] U.S. Cl. ..... 242/35.5 A; 198/347.1; 414/751; 901/16

[58] Field of Search ..... 242/35.5 A, 35.5 R; 901/7, 16; 414/751; 198/347, 351, 353, 354, 370, 468.6, 469.1, 470.1, 476.1

[56] References Cited

U.S. PATENT DOCUMENTS

| | | | |
|---|---|---|---|
| 4,319,861 | 3/1982 | Seragnoli | 198/347 X |
| 4,564,329 | 1/1986 | Bantien | 198/347 X |
| 4,600,358 | 7/1986 | Graf | 901/16 X |
| 4,648,774 | 3/1987 | Dorumsgaard et al. | 901/16 X |
| 4,648,777 | 3/1987 | Eichenauer | 414/751 X |
| 4,657,194 | 4/1987 | Wey et al. | 242/35.5 A |
| 4,721,262 | 1/1988 | Langen | 242/35.5 A |

FOREIGN PATENT DOCUMENTS

| | | | |
|---|---|---|---|
| 0026160 | 4/1981 | European Pat. Off. . | |
| 0099959 | 2/1984 | European Pat. Off. | 242/35.3 A |
| 2945861 | 5/1981 | Fed. Rep. of Germany . | |
| 3418814 | 11/1985 | Fed. Rep. of Germany . | |
| 3435951 | 4/1986 | Fed. Rep. of Germany . | |
| 3604018 | 9/1987 | Fed. Rep. of Germany . | |

*Primary Examiner*—Stanley N. Gilreath
*Attorney, Agent, or Firm*—Shefte, Pinckney & Sawyer

[57] ABSTRACT

A method and apparatus for transporting a plurality of packages from the winding stations of a textile machine to a location for further handling or processing is provided. A pair of movable arms movably mounted to a carriage releasably engage a package support means to move the package support means between a package receiving position in which it receives packages transferred thereto by the traveling service unit of the textile machine and a transport position in which the package support means is released to a conveyor belt assembly for transport to the location for further handling or processing. The carriage includes rollers which travel along rails mounted on a selectively extendable and retractable bracket. The bracket is vertically movably supported on a vertical post. The movement of the vertical post and the extendable and retractable bracket are controlled to manipulate the arms to engage an empty package support means once it has released a package support means with a plurality of packages thereon to a conveyor belt assembly.

16 Claims, 8 Drawing Sheets

FIG.7
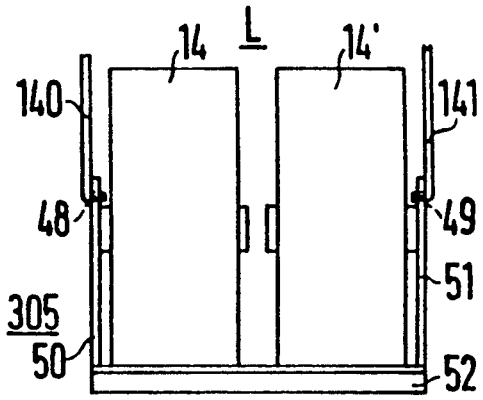
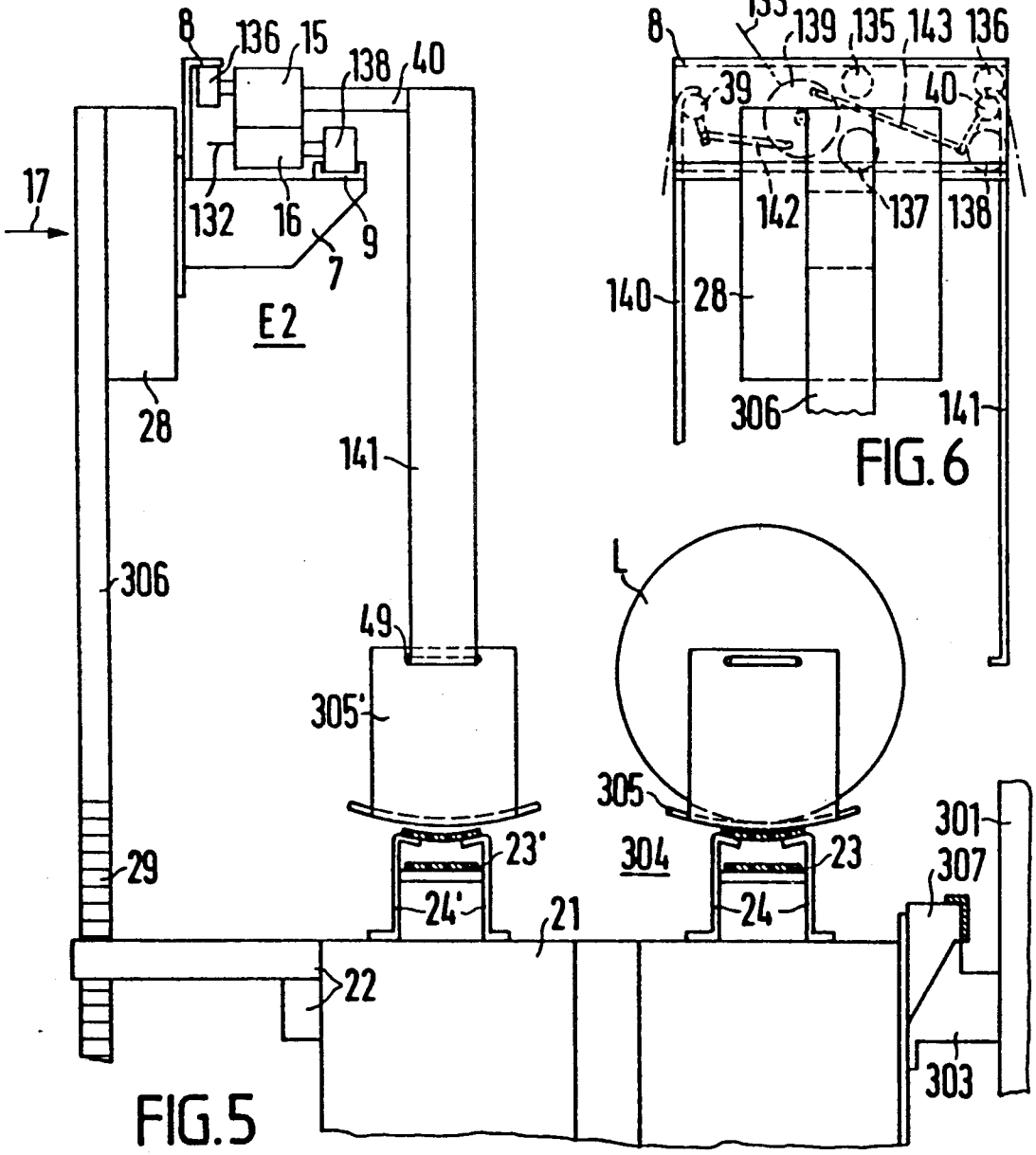
FIG.6
FIG.5

METHOD AND APPARATUS FOR TRANSPORTING GROUPS OF PACKAGES FROM WINDING STATIONS OF A TEXTILE MACHINE TO A FURTHER HANDLING LOCATION

This is a continuation-in-part of co-pending application Ser. No. 330,626, filed Mar. 30, 1989, now abandoned.

BACKGROUND OF THE INVENTION

The present invention relates to a method and apparatus for transporting groups of packages from winding stations of a textile machine or the like to a location for further handling or processing.

The winding stations of certain textile machines can be operated to build cross-wound packages and these cross-wound packages are transported to locations for further handling or processing, such as yarn twisting or doubling machines which combine yarn from a pair of cross-wound packages. If a pair of the cross-wound packages are to be combined at a doubling machine, it is advantageous if the cross-wound package supplying the cover yarn has a greater amount of yarn than the other cross-wound package of the pair, which supplies the core yarn. To this end, one economical configuration of the winding stations for producing the cross-wound packages is a configuration in which the individual winding stations alternately produce cross-wound packages of different lengths or in which certain winding stations produce packages of one length while other winding stations produce packages of a different length.

To expedite the transport and handling of the cross-wound packages for twisting or doubling, it is advantageous to segregate and transport the packages in separate pairs, each including one package having one length of yarn wound thereon and the other package having another length of yarn wound thereon.

SUMMARY OF THE INVENTION

The present invention provides a method and apparatus for reliably maintaining packages of different yarn lengths or characteristics together as pairs during their travel between the winding stations and a location for further handling or processing.

The present invention provides, in the operation of a textile machine of the type having a plurality of winding stations for building yarn packages and a package transporting device for transporting packages from the stations to a location for further handling or processing, a method including delivering package support means to the stations in condition for transferring packages thereto, transferring a plurality of packages from the stations onto each package support means and placing the package support means on the package transporting device for transporting the package support means, and the packages supported thereon, from the stations to the location for further handling or processing. According to one aspect of the present invention, in the transferring, a plurality of packages is transferred from one station to one of the package support means.

According to another aspect of the present invention, in the transferring, packages of different characteristics are transferred to each package support means. The method further includes positioning the package support means for transfer of packages thereto at a clearance from the package transporting device to permit transport therepast of other package support means on the package transporting device.

The present invention also provides an apparatus for use in a textile machine of the type having a plurality of winding stations for building yarn packages and a package transporting device for transporting packages from the stations to a location for further handling or processing. The apparatus includes a plurality of package support means, each package support means being capable of supporting a package thereon, means for delivering the package support means to the stations in condition for transferring packages thereto, means for transferring a plurality of packages from the stations onto each package support means and means for placing the package support means on the package transporting device for transporting the package support means, with packages thereon, from the stations to the location for further handling or processing.

Preferably, in the apparatus of the present invention each package support means is capable of supporting a plurality of packages thereon and means are provided for moving each package support means between a package receiving position for transfer thereto of a plurality of packages by the transfer device and a transport position in which the package support means is placed on the device for transporting packages to the location for further handling or processing. The moving means includes means for releasably engaging the package support means to support the package support means in the package receiving position and to release the package support means in the transport position.

Preferably, the moving means includes means for manipulating the releasable engaging means for engaging another of the package support means for movement thereof between the package receiving position and the transport position. Preferably, each of the package support means includes a pair of spaced apart engagement members and the moving means includes a carriage and a carriage support assembly, the carriage being movable along the carriage support assembly, and the releasable engaging means includes a pair of arms movably mounted to the carriage. The arms have free end portions engagable with the engagement members of the package support means for engagement of the package support means by the moving means and the releasable engaging means includes a selectively operable motor means, mounted on the carriage, for selectively moving the arms into and out of engagement with the engagement members of the package support means to selectively engage and release the package support means.

Preferably, the arms are pivotally mounted to the carriage, each arm being pivotable between an engagement position in which it engages one of the engagement members of one of the package support means and a release position in which it releases the one package support means. The moving means preferably includes drive means, connected to the carriage, for selectively moving the carriage in a direction generally transverse to the transfer direction of the packages between the stations and the package support means for selectively repositioning the package support means for transfer of packages thereto from a plurality of the stations.

Preferably, the moving means includes a support device for supporting the carriage support assembly above the device for transporting packages, the support device including a vertical post, means for selectively vertically moving the vertical post and a selectively extendable and retractable bracket mounted to the vertical post. The vertical post and the bracket cooperate together to move the arms between a position for engaging one of the package support means in condition for receipt of packages, a position for supporting the engaged package support means in the package receiving position and a position for releasing the engaged package support means, with packages supported thereon, onto the device for transporting packages.

Preferably, the device for transporting packages includes a pair of conveyor assemblies having conveyor belts, one conveyor assembly for delivering the package support means to the stations in condition for receipt of packages thereon and the other conveyor assembly for transporting the package support means to the location for further handling or processing. Preferably, the conveyor belts travel generally parallel to one another.

BRIEF DESCRIPTION OF THE DRAWINGS

FIG. 5 is a side elevational view of the transport apparatus of the present invention, showing a package support means with a plurality of packages supported thereon disposed on one conveyor assembly for transport to a location for further handling or processing and a package support means in condition for receipt of packages thereon engaged by the transport apparatus of the present invention;

FIG. 6 is a partial front elevational view of the upper portion of the releasable engaging means of a the transport apparatus of the present invention;

FIG. 7 is a partial front elevational view of the lower portion of the releasable engaging means of the transport apparatus of the present invention;

DETAILED DESCRIPTION OF THE PREFERRED EMBODIMENTS

Figure 1:
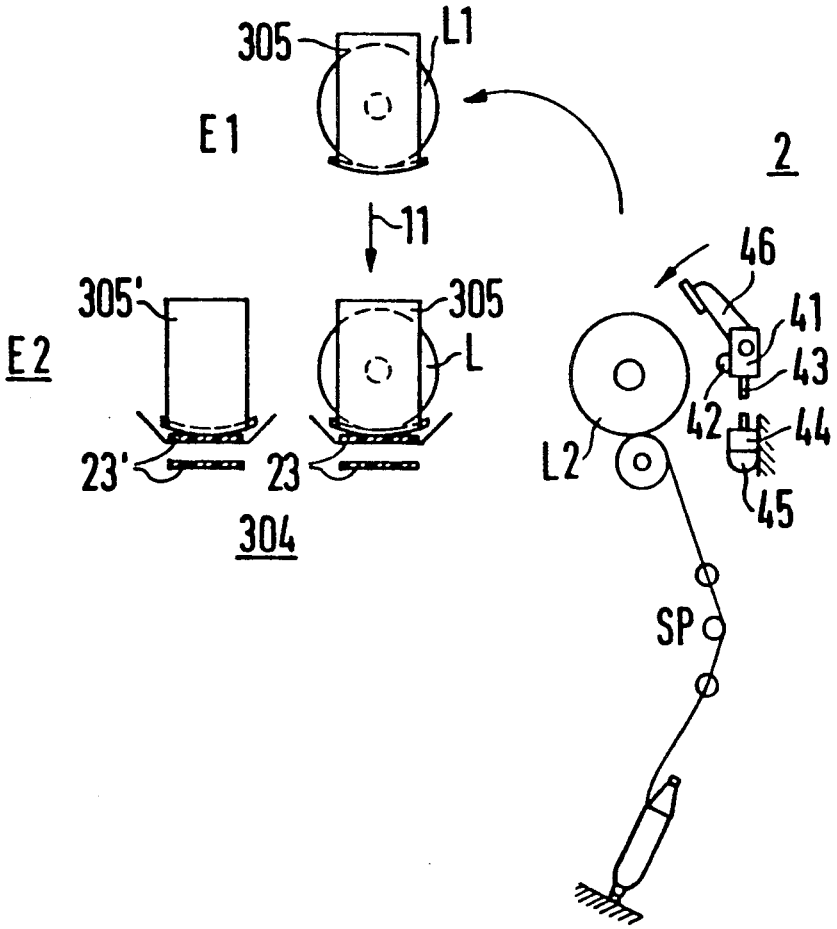
FIG. 1 is a schematic representation of one preferred embodiment of the transport apparatus of the present invention for transporting a plurality of packages from the winding stations of a textile machine to a location for further handling or processing.

In FIGS. 1-7, one preferred embodiment of the transport apparatus of the present invention is illustrated. The transport apparatus is adapted to transport discrete pluralities of packages produced at one of a plurality of winding stations 301 of a winding machine 300. Each winding station 301 is provided with a transport apparatus according to the present invention. A traveling service unit 2 travels to the individual winding stations 301 to remove cross-wound packages 14 therefrom and transfer these packages to the transport apparatus of the present invention.

The transport apparatus of the present invention includes a package transport device 304 including a first conveyor assembly having a conveyor belt 23 drivingly supported on a frame 24 and a second conveyor assembly having a conveyor belt 23' drivingly supported on a frame 24'. The frames 24, 24' are mounted on the machine frame 21 of the winding machine 300. The conveyor belts 23, 23' are spaced from one another in the package transfer direction and extend generally parallel to one another. Each conveyor belt 23, 23' extends to a location (not shown) for further handling or processing of the cross-wound packages 14.

The transport apparatus of the present invention additionally includes a plurality of package support means 305, each package support means being capable of individually supporting a plurality of packages thereon, and a means E2 for moving the package support means 305 between a package receiving position for transfer thereto of a plurality of packages by the service unit 2 and a transport position in which the package support means 305 are placed on the first conveyor belt 23 for transport by the package transporting device 304 to the location for further handling or processing. Additionally, the moving means E2 is capable of engaging an empty package support means 305', in condition for receipt of packages thereon, on the second conveyor belt 23' and moving the engaged package support means 305' to the package receiving position.

Each winding station 301 includes a winding drum 13 in frictional driving engagement with a package 14 being wound. A package spindle 12 support the package 14 and is pivoted about a pivot 302. The winding stations 301 are connected to a machine frame 21 through a connecting frame 303.

A rail 309 is supported from the machine frame 21 by supports 307. Additional supports 308 on the machine support additional rails 310 and 311. The service unit 2 is movable along the length of automatic winding machine 300 on the rails 309,310 and 311. In the preferred embodiment, the service unit 2 is an automatic package doffer which operates to doff wound packages 14 and replace them with empty winding cores. Since the present invention is concerned only with the removal of packages and not with the placement of empty cores, the structure of the service unit 2 for accomplishing the placement of empty cores is neither described nor illustrated herein.

Service unit 2 is supported on rails 309 and 310 by rail wheels 312 and 313, respectively, and is guided along these rails by guide wheels 314 and 314. At least one of the rail wheels 312 and 313 is driven by a controllable motor of known construction. Service unit 2 can be automatically moved to a desired winding station and positioned there in order to doff a finished package, insert an empty core and also to perform certain other types of work such as cleaning of the machine components.

Typically, service units, such as service unit 2, are provided with one or several control mechanism that control their sequential operations. In the preferred embodiment, the service unit 2 also includes such control mechanisms, those of which that pertain to the present invention will be described.

The service unit 2 includes a pneumatic piston 316. A telescoping arm 317 of the pneumatic piston 316 is connected at its outer end to the spindle 12. The arm 317 can be telescoped out to swing the arm of the spindle 12 to the side and thereby open the spindle to release a package or for receipt of a winding core. When not activated, the arm 317 is retracted back into the pneumatic piston 316.

Figure 2:
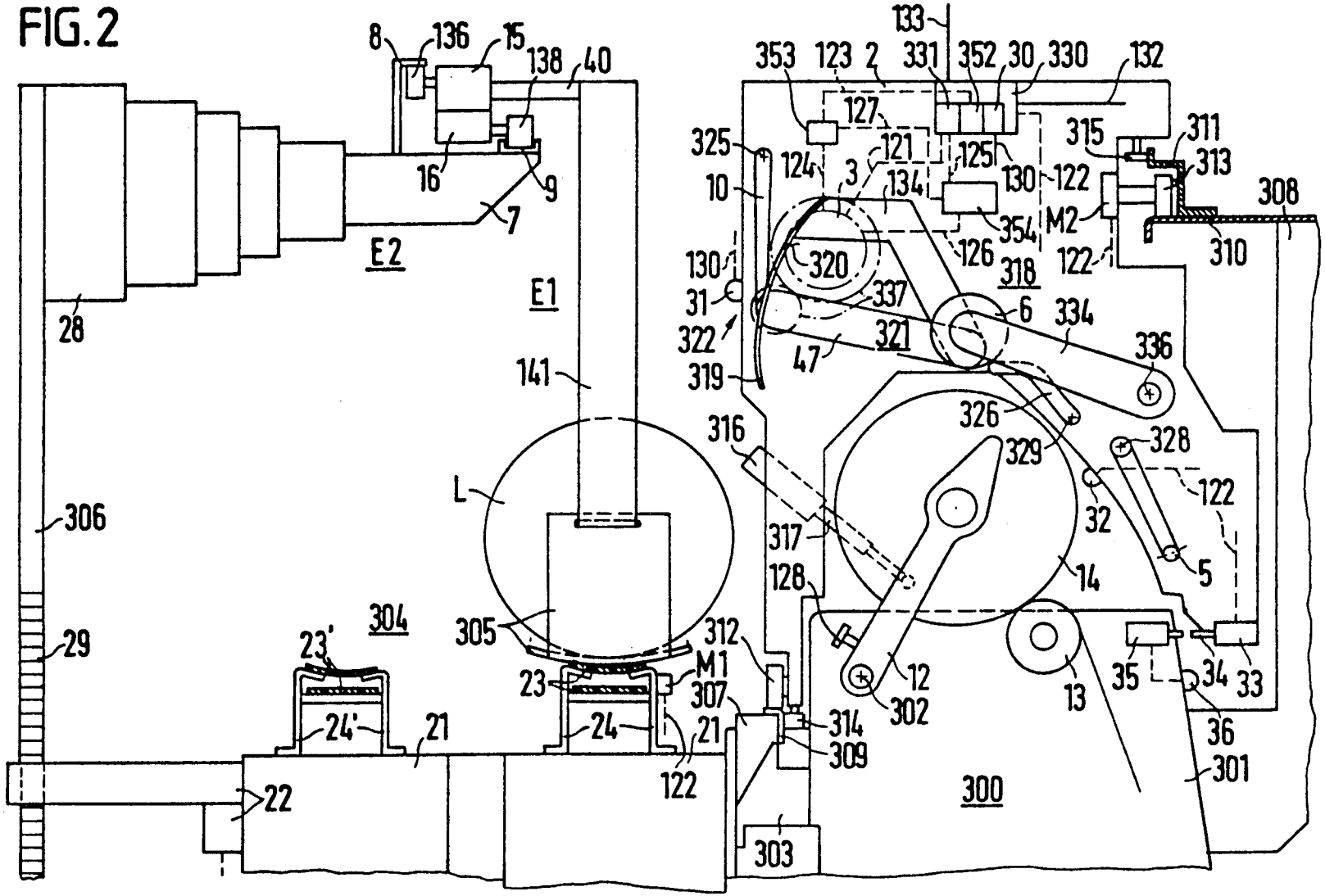
FIG. 2 is a side elevational view of the transport apparatus of the present invention, showing a traveling service unit of the type having means for transferring a package from the winding station to the transport apparatus of the present invention and showing a package support means with a plurality of packages supported thereon being disposed in the transport position by the transport apparatus of the present invention for transport by a conveyor assembly to a location for further handling and processing.
Figure 3:
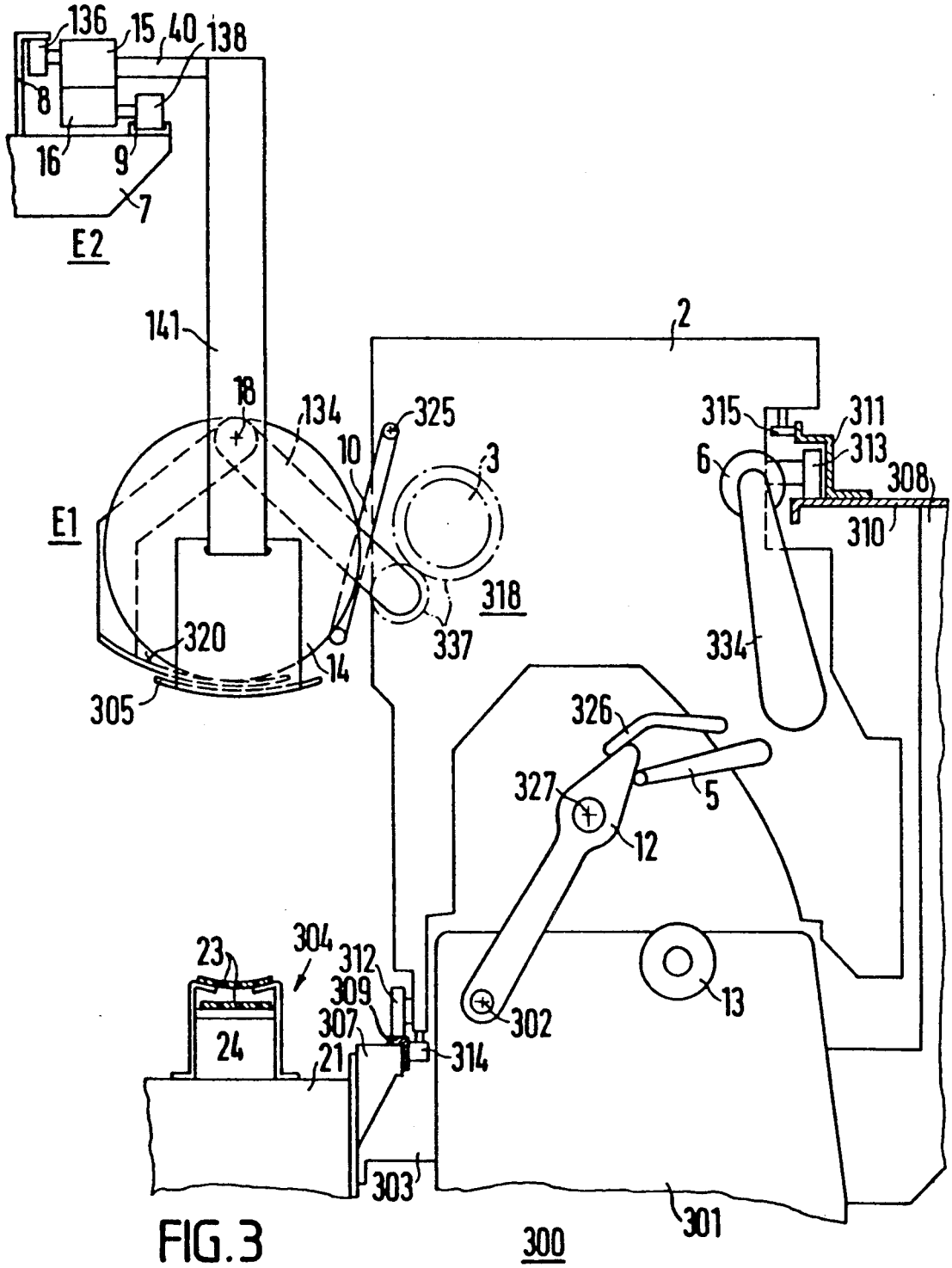
FIG. 3 is a partial side elevational view of the transport apparatus of the present invention, showing a package being transferred by the traveling service unit from a winding station to a package support means of the present invention.
Figure 4:
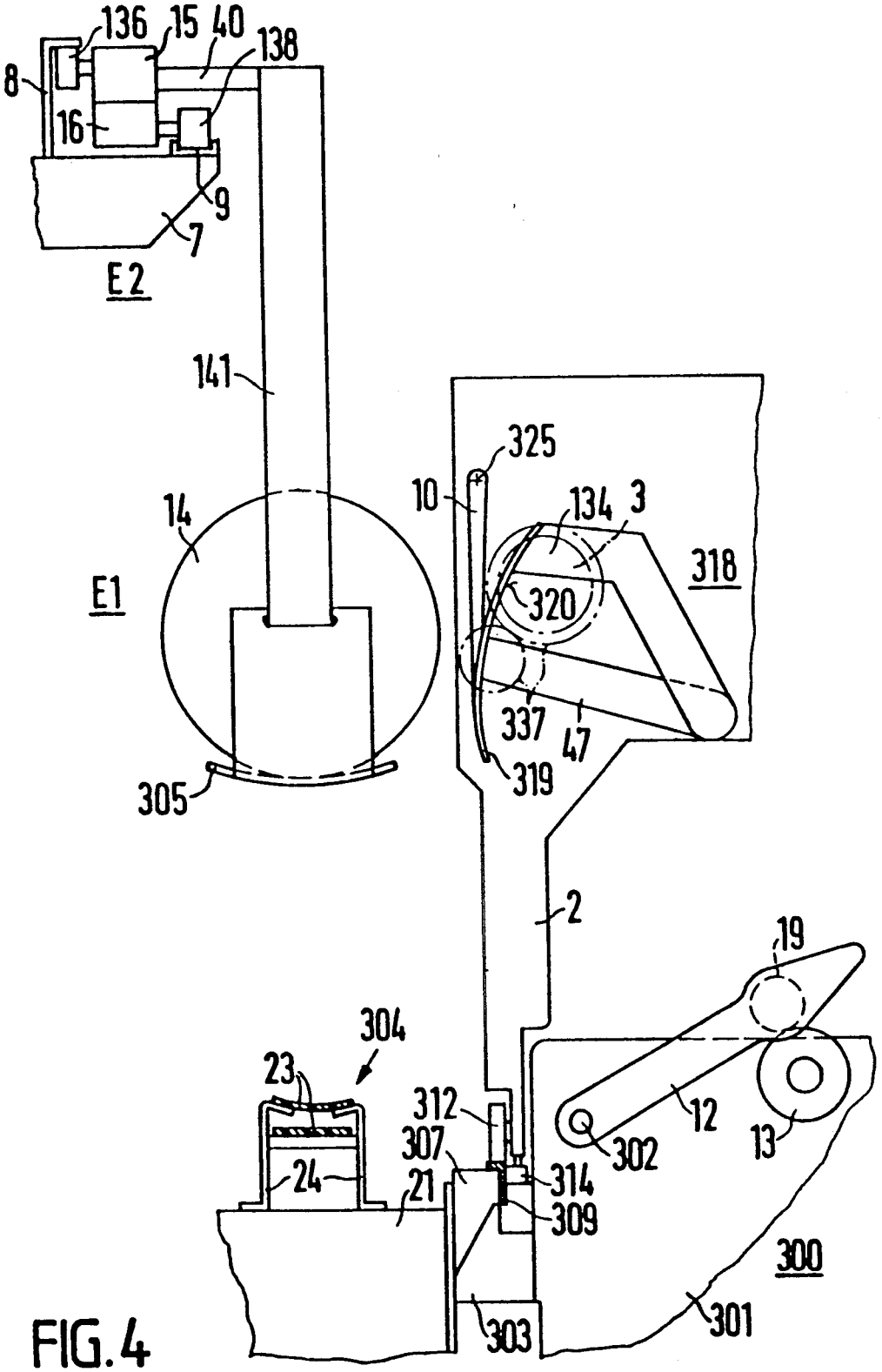
FIG. 4 is a partial side elevational view of the transport apparatus of the present invention, showing a package support means with a package supported thereon.

To remove packages 14 from the spindles 12, the service unit 2 includes the means 318 for transferring packages according to the preferred embodiment of the present invention, the operating mechanism of which is illustrated in detail in FIG. 3. The transferring means 318 includes a package carrier member 319 which moves from a retracted rest position (shown in FIG. 4) to a package receiving position in which a wound package 14 is released for support thereon. The carrier member 319 includes a concave upper surface 320 positioned at the end of a support arm 134. Means for imparting translational motion to the support arm 134 and means for rotating the support arm for positioning of the package carrier member 319 are provided, using a mechanism 321 (FIG. 2) for providing translational motion and a mechanism 322 (FIG. 2) for rotating the support arm, which operate to rotate the support arm 134 to move the package carrier member 319 along an arcuate path for withdrawal from under the package so that the package 14, which is positioned over the package support means 305, may be released thereonto.

the service unit 2 also includes a stop member 10 which is movable from a retracted position to a position in engagement with the package opposite the direction of withdrawing of the carrier member to resist lateral and rotational movement of the package as the carrier member is withdrawn and the package released onto the package support means 305. The retracted position of the stop member 10 is shown in FIG. 2, while the support position in which the stop member 10 engages the side of the package is shown in FIG. 3. The stop member 10 engages a cross bar supported on an arm, with the arm rotatably connected to the service unit 2 at a pivot 325 and controlled by a conventional mechanism such as a cam mechanism. The service unit 2 additionally includes a package raising means 5 which cooperates with a spindle tilting mechanism 326 to move the spindle 12 to a position in which the package 14 is in a desired position with a predetermined orientation of its longitudinal axis. The desired position of each package is the position in which it is spaced from the driving drum 13 and the package axis 327 is horizontal.

As shown in FIG. 3, the spindle tilting mechanism 326 cooperates with the forward carry arm of the spindle 12 while the raising mechanism 5 cooperates with the underside of the spindle arm.

The raising mechanism 5 is rotatably supported on the service unit 2 at a pivot 328 (FIG. 2) and is upwardly movable from its retracted inactive position shown in FIG. 1 to engage the arm of the spindle 12. Movement of the raising mechanism 5 can be controlled by an appropriate control mechanism, such as the control mechanism that controls the movement of the stop member 10.

The orientation of the carrier member 319 can be varied with respect to the variable of the cone diameter and cone conicity. To adjust for these variables, the control unit 330 sets the member 319 to the appropriate position to engage the package 14. The control unit 330 has a self-actuating spacing controller 331 which controls the position of the carrier member 319 so that it is set a predetermined spacing, within a predetermined millimeter or centimeter range, from the outer surface of the package 14. The spacing controller 331 has package sensing means that includes an angle indicator which indicates the rotational position of a pivoted arm 334 carrying a package engaging roller 6. The angle through which are arm 334 rotates to make contact between the roller 6 and the outer surface of the package 14 provides an indication of the diameter of the package.

The pivoted arm 334 is rotatably mounted on the service unit 2 at a pivot point 336. The rotational movement of the arm 334 is transmitted to an impulse disc (not shown) coaxial with a gear mechanism (not shown) rotated by a mating gear (not shown) fixedly mounted to the arm 334. A sensor (not shown) monitors the impulse disc so as to provide a signal corresponding to the magnitude of pivoting of the arm 334. One arrangement by which the sensor can monitor the impulse disc is an arrangement in which the disc has magnets spaced around its circumference to induce an electrical impulse in a winding in the sensor.

The roller 6 positioned at the free end of the pivot arm 334 rotatably engages the package 14 during selected phases of the operating of the winding machine. The sensor measures the pivot angle of the arm 334 which the roller 6 is moved out of its retracted position (shown in FIG. 2) and lowered to engage the package 14. The greater the diameter of the package, the fewer the impulses that will be measured by the sensor.

Figure 8:
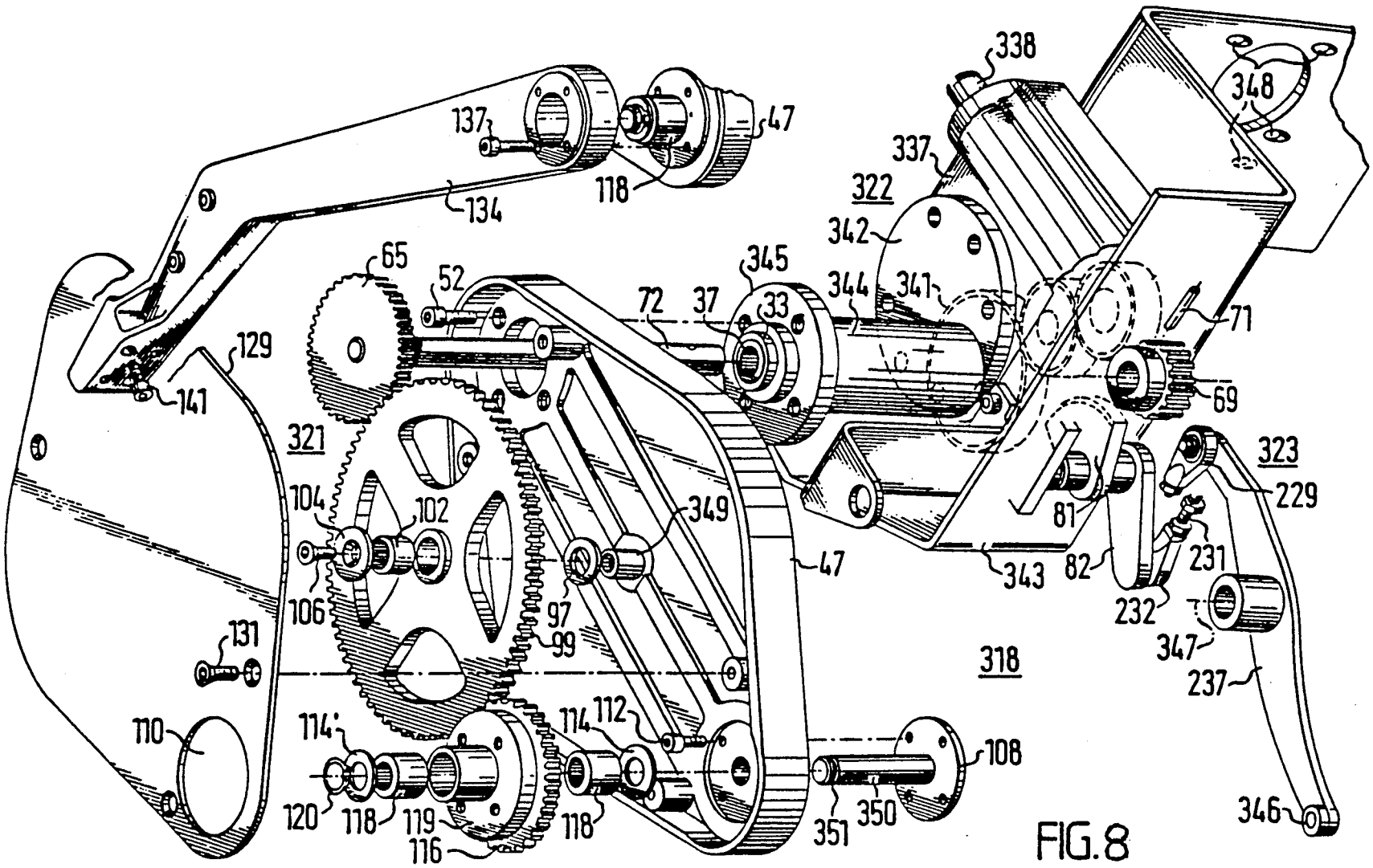
FIG. 8 is an enlarged exploded perspective view of the operating mechanism for the positioning means and moving means of the transport apparatus of the present invention.

The mechanism 321 for providing translation motion ensures that the carrie member 319 and the package 14 carried thereon are not tipped, twisted, rotated or tilted irrespective of the movement of the support arm 134. As seen in FIG. 8, the translational motion mechanism includes a gear assembly having a drive gear 65, an intermediate gear 99 and a driven gear 116. These gears are mounted on a pivoted operating arm 47 in the form of a housing, which is connected to the output shaft of a gear motor 322. As seen in FIG. 8, the gear motor 322 has a gear box 337 and a drive shaft 338, with the gear box 337 being mounted on a frame 343 and having a cover plate 342. The output of the gear box 337 is transmitted by a gear 341 to a main shaft 344 connected thereto. A main shaft collar 33 and a flange 345 are secured to the main shaft 344, and the operating arm or housing 47 is secured to the flange 345 by bolts 52.

As seen in FIG. 8, the drive gear 65 is connected through the gear box 337 to the support arm rotating mechanism 323, which cooperates with a control mechanism having a cam (not shown) in driving contact with a follower 346 on one end of a lever 237 that is movably mounted on the service unit 2 for pivoting about an axis 347. The other end of the lever 237 is connected to an end 229 of an adjustable rod 231 having its other end 232 connected to a crank arm 82 that is rotatably mounted on the gear box frame 343 and has mounted thereon a gear segment 81. The gear segment 81 meshes with a gear 69 that is fixed by a key pin 71 on one end of a shaft 72 that is rotatably mounted within an axial bore 37 in the main shaft 344 and is connected at its other end to the drive gear 65. To adjust the plane of pivoting of the housing 47, the gear frame 343 is adjustably connected to the housing of the service unit 2. For this purpose, the gear frame 343 is provided with longitudinal slots 348 which allow limited adjustment of the mounting on the service unit frame.

Approximately in the middle of the housing 47 is a threaded stud 349 having a washer 97 supported thereon. The intermediate gear 99 is mounted on a bearing 102 which is mounted on the stud 349. Thus, the intermediate gear 99 is thereby supported on the stud 349 and spaced from the housing 47 by the washer 97. A screw 106 is threadably received in the stud 349 and a washer 104 on the opposite side of the intermediate gear 99 is positioned on screw 106. The drive gear 65 and the driven gear 116 each have the same number of gear teeth so that the translation ratio between the gears is 1:1.

At the end of housing 47 opposite the end at which the shaft 72 enters in an opening through which a stud shaft 350 projects. One end of the stud shaft 350 is connected to a flange 108 having threaded holes for receiving screws 112 which extend through aligned hoses in the housing 47. Thus, the flange 108 is secured to the housing 47. The driven gear 116 is rotatably supported on the stud shaft 350 on a bearing 118 which allows the gear to rotate about the stud shaft 350. A washer 114 spaces the bearing 118 from the inside of housing 47 and a second washer 114' spaces the bearing 118 from the other side of housing 47, with a lock washer 120 engaging an annular groove 351 in the stud shaft 310 to secure the gear 116 to stud shaft 350.

The drive gear 116 has a flange 119 which is connected to the support arm 134 by screws 137. The thickness of the flanges 119 is such that the flange projects through an opening 110 in a side cover 129 of the housing 47 with the side cover 129 being secured to the housing 47 by screws 131.

Figure 9:
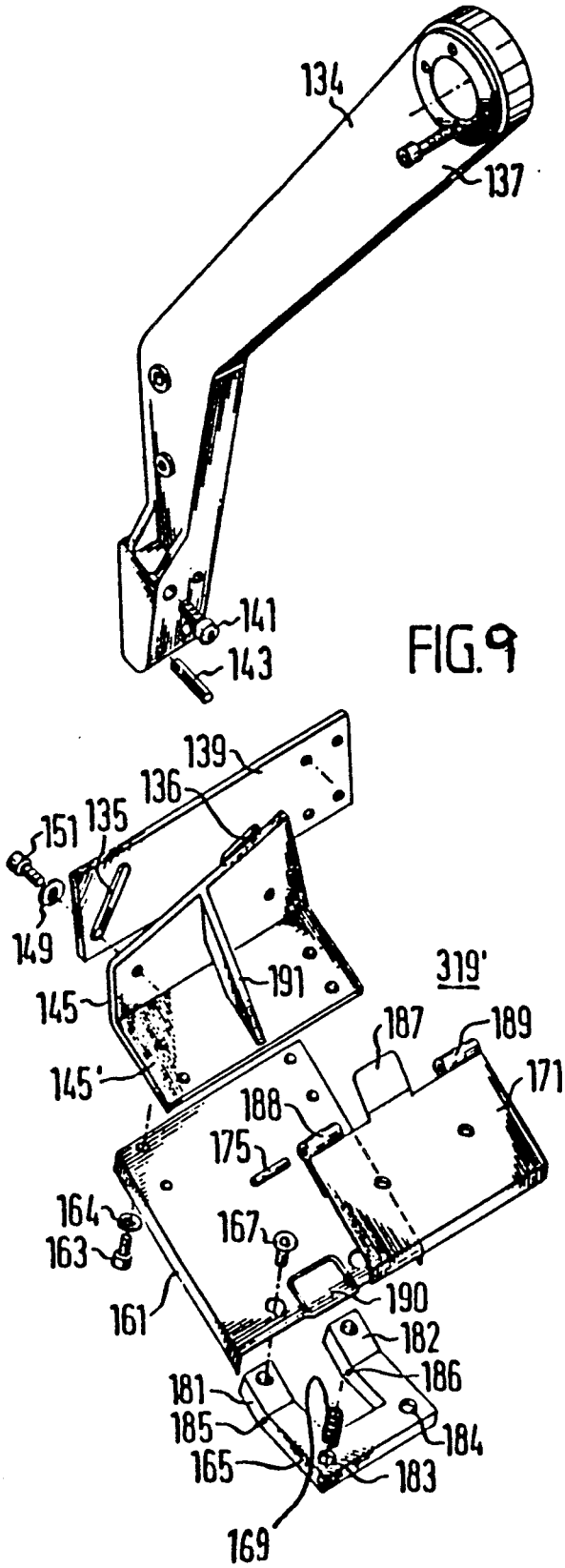
FIG. 9 is an exploded perspective view of a preferred embodiment of the package carrier member included in the package transferring means of the present invention.

The carrier member 319 has an upper concave surface 320 for supporting a package 14. The carrier member can be formed from a section of pipe, or a correspondingly bent sheet, or two or more components secured together at an angle to one another. The latter is illustrated in FIG. 9, in which the carrier member 319' includes a plate 139 secured to the free end of the support arm 134 by two screws 141 and two slotted pins 143 (only one screw 141 and one pin 143 being shown). The plate 139 has two non-parallel slots 135 and 136 which receive screws 151 to thereby connect an angle plate 145 to the plate 139. Washers 149 are mounted on the screws 151. The screw 151 can be moved along the slots 135 and 136 to vary the position of the angle plate 145 with respect to the plate 139 so that the foot portion 145' of the angle plate 145 can be adjusted over a range of positions. The angle plate 145 forms one component of the carrier member 319'. Another component is a plate 161 that includes a stirrup 165 having upwardly bent feet 181 and 182 that are secured by screws 167 to the plate 161. The stirrup 165 includes recesses 183 and 184 that receive coil springs 169. The feet 181 and 182 of the stirrup 165 have aligned hinge pin receiving holes 185 and 186, respectively. A second plate 171 about stirrup 165 includes an upwardly bent nose 187 and two hinges 188 and 189. The nose 187 seats in a recess 190 in the middle of the end of first plate 161. Hinge pins 175 are inserted through hinges 188 and 189 and into the holes 185 and 186 whereby the second plate 171 is hingedly connected to the stirrup 165. The hinge arrangement and the spring survived the second plate 171 with spring-cushioned movement through a limited range. The plate 161 is secured to the foot position 145' of the angle plate 145 by a plurality of bolts 163, the bolts having associated washers 164 (only one bolt 163 and one washer 164 is shown).

When small packages are handled by the carrier member 319', the packages lie on plates 161 and 171 while large packages are supported by a cross piece 191 of the angle plates 145, which cross pieces 191 contacts packages of relatively large diameter along their side surfaces.

As shown in FIG. 5, the electronic control mechanism 330 is provided on the service unit 2 to control the movement of the carrier member 319 to the appropriate package receiving position. The electronic control mechanism 330 comprises an electronic comparator 352 which is operably connected to the spacing controller 331 that is operably connected to the rotation mechanism 322 by a connecting lead 121 and operates a drive member 3 in accordance with signals received from the comparator 352. The comparator 352 is connected by a lead 123 to a rotation counter 353 of the drive motor 3, with the rotation counter 353 being connected through a lead 124 to the drive motor 3.

When the cam mechanism of the package transferring apparatus 318 is activated, the arm 334 is rotated downward until the roller 6 engages the surface of the package 14. The sensor counts the impulses received from the impulse disc during the downward rotation of the arm 334 and transmits its count to the comparator 352. The comparator 352 then activates the spacing controller 331, which in turn signals drive motor 3 through lead 121 to activate the rotation mechanism 322, which rotates the housing 47 from its retracted, inactive position (FIG. 2) to a package receiving position. During the operation of the drive motor 3, the rotation counter 353 counts the rotation of the drive motor output shaft and transmits the result to the comparator 352, which compares the count from the rotation counter 353 with the count from the sensor and, when the two counts correspond, stops the spacing controller 331. If the package diameter is large, the sensor will count only a few impulses. In that circumstances, the drive motor 3 stops after a corresponding number of rotations, which need not necessarily correspond exactly with the impulse count. In the preferred embodiment, the carrier member 319 is moved to approximately one centimeter under the package 14.

In the package 14 is of a small diameter, the arm 334 will pivot downward to a relatively large degree and the sensor therefore counts more impulses. However, after being raised to the position shown in FIG. 2, the underside of a smaller package would not be as low as the underside of the illustrated large package 14. This means that the more impulses sensor counts, the fewer the rotations of the output shaft of drive motor 3 would be allowed. the number of rotations for each individual series of package sizes can be empirically determined and stored in the comparator 352.

The spacing controller 331 is operatively connected through a connecting lead 125 with a control device 354, which is connected through a connecting lead 126 with the drive motor 3. Once the spacing controller 331 has set the carrier member 319 to the appropriate spacing, the control device 354 takes over further control of the drive motor 3 so that the housing 47 can be rotated between the package receiving position and the package releasing position (FIG. 3). The control of the drive motor 3 through the control device 354 is related to the number of rotations counted by the rotation counter 353 and transmitted through the lead 127 to the control device. 354. The rotation count of the drive motor 3 caries according to the package size measured by the sensor and this relationship can be empirically determined. The control device 354 also controls the return movement of housing 47 to the beginning position shown in FIG. 2.

The traveling service unit 2 operates as follows to transfer the package 14 from the spindle 12 to the package support means 305,305'. Initially, the size of the package being would is sensed by the position of the spindle 12 by a microchip 128 which senses the angular position of the spindle 12 and sends a stop signal to the drive of the winding drum 13 and a call signal tot he service unit 2 to immediately respond or, in known fashion, to stop at the winding station 301 in the course of its travel. The roller 6 is then lowered to engage the surface of the package, during which the sensor counts the impulses and transmits the count through the lead 122 to the control device 330. Then, the spindle raising mechanism 5 and spindle tilt apparatus 326 are activated to move the spindle 12 with the package 14 thereon to the predetermined axial position 327. The rotation mechanism 322, the translation motion mechanism 321 and the control device 330 then manipulate the package carrier 319 in response to the sensed package diameter such that the carrier member 319 is positioned under the package 14 at a distance of approximately one centimeter from the surface of the package.

If desired, further processing of the package 14 can now proceed with the package raised from the winding drum 13. For example, the yarn end can be wound on the core end to form a yarn reserve, in which event the friction roller 6 operates for a certain period. For this further processing, the roller 6 may be driven by its own drive motor (not shown). When the further handling is finished, the arm 334 pivots the roller 6 to the retracted position shown in FIG. 2. Then, the spindle opener 316, controlled by a sequence control device, opens the spindle 12 whereby the package 14 is released from the spindle 12 onto the carrier member 319. Then, the rotation mechanism 332 pivots the housing 47 in a counterclockwise direction sequentially upwardly, laterally and downwardly to the release position shown in FIG. 3 and immediately stops due to the action of a self-stopping device such as, for example, a combination of worm gears within the rotation mechanism 322. A the same time, the translation motion mechanism 321 insures that package 14 neither tilts nor rolls during transport.

As shown in FIG. 3, the package 14 is then delivered to the package support means 305. Then, the sequence control device controls the stop member 10 so tat its cross rod lies against the surface of the package 14, as shown in FIG. 3. At the same time or subsequent thereto, the retraction mechanism 323 is operated to retract the support arm 134. The support arm 134, which carries the carrier member 319, is pivoted in a clockwise direction so that the carrier member 319 is retracted along an arcuate path corresponding generally to the curvature of the surface 320 of the carrier member 319 with the stop member 10 being located on the side of the package opposite the direction of carrier member retraction. During this movement, the support arm 134 pivots around the pivot point 18 shown in FIG. 3. Following this movement, the support arm 134 and the carrier member 319 are retracted to the positions shown in FIG. 4 with the package thereby released onto the package support means 305. During this movement, the carrier member 319 is upwardly pivoted along an arcuate path.

During the return the housing 47 and stop member 10 to their initial positions, the spindle 12 automatically receives a new empty winding core from the service unit 2 so that production of another package at the winding station 301 can begin. In the event that the service unit 2 has no further function at the winding station 301, it receives a signal to move to another station.

As soon as packages have been transferred from all of the winding stations, the package support means 305 can be detached for transport of the packages or can be lowered to deposit the packages on conveyor 23 of the package transport device 304. If, for example, the completed packages are removed with the package support means 305, packages can be transferred directly to the conveyor belt 23 of the package transport device 304 as shown in FIG. 6. In this regard, the transferring means 318 need not be modified or changed except for the modifications that the housing 47 is pivoted through a longer arc and the stop member 10 is appropriately lengthened.

In the preferred embodiment, a cylindrical package 14 is illustrated. If conical packages are wound, it may be necessary to set the pivoting plane of the housing 47 with respect to the conicity of the package in addition to corresponding adjusting the stop member 10 with respect to the diameter of the package, the conicity of the package and the height of the machine frame. This can be done, for example., through appropriate positioning of the gear assembly 343 along the longitudinal slots 348 (as seen in FIG. 8). Also, the carrier member 319' can be adjusted to the various conicity of the packages, for example, by adjustment along the slots 135 and 136 (FIG. 9).

The apparatus of the present invention is adapted for use with various winding machines. In certain of these machines, for example, the package driving drum 13 continues to run after the desired yarn feeding is completed so that the packages continue to rotate and thereby occasionally wind the yarn end onto the package until the spindle raising mechanism 5 lifts the spindle from the rotating drum 13.

The lifting of the spindle 12 can be accomplished by a mechanism at the winding station 301 rather than on the service unit 2. For this reason, it is not always necessary that the service unit 2 be equipped with a spindle raising mechanism 5. However, such a mechanism is necessary if the apparatus of the present invention is to be used with existing machines.

In some circumstances, each individual winding station is equipped with a self-driven winding drum 13 so that the rotation of the drum ceases when the desired package fullness has been achieved. When used with machines of this type, the service unit 2 engages an already non-moving package which does not have to be raised unless, for example, the package requires a yarn reserve to be added. For such purpose, the service unit 2 is preferably provided with the spindle raising mechanism as well as the spindle tilting mechanism. It is to be noted that, in some circumstances, a spindle tilting mechanism can be provided at each individual winding station.

If the carrier member 319 is pivoted from the initial position shown in FIG. 1 to a position underneath the package 14 without any preparation movement of the housing 47, the carrier member 319 would contact the package before it could be positioned thereunder. For this reason, it is necessary to pivot the housing 47 in a clockwise direction either before or at the same time as the carrier member 319 is pivoted. After the carrier member 319 has picked up the package 14, the housing 47 is pivoted in a clockwise direction around the pivot point 355 shown in FIG. 2.

The translational motion mechanism 321 can be positioned such that the support arm 134, during the period of movement of the housing 47, hangs freely from the pivot point 356, as shown in FIG. 2. The package 14, together with the carrier member 319 and the support arm 134, hang in constant balance underneath the pivot point 356. Such an arrangement is not advantageous, however, because it is impossible to avoid some free pivoting during the transfer operations. Such pivoting can cause the package 14 to fall from carrier member 319 as well as other undesirable consequences. For this reason, a controlled translation motion mechanism 321 of the type described above or equivalent is preferred, although more components may be required. Also, the coordination between the positioning mechanism 232 and the translational motion mechanism 321 works smoother with a controlled system.

As shown in FIGS. 1–6, the service unit 2 has a portal-type housing. This housing, however, does not in any way limit the mobility of the package transferring means 318 because numerous movable parts are on the front side of the housing. All the upwardly pivoting parts remain behind the movement plane of the package 14. The housing of the service unit 2 is for this reason preferably constructed as a portal-type housing so that it can travel through the winding stations 301. Typically, there is sufficiently large room to accommodate this.

Instead of measuring the diameter of packages 14 with the sensor, the diameter measurement can be accomplished i conventional ways, such as, for example, with electronic components.

The moving means E2 includes a releasable engaging means having a pair of arms 140, 141 for releasably engaging the package support means 305, 305' and includes a support device in the form of vertical post 306 and a selectively extendable and retractable telescoping bracket 7. The vertical post 306 includes a threaded portion 29 which is meshingly engaged by a gear (not shown) driving operated by a motor 22 mounted to the machine frame 21. The vertical post 306 is selectively vertically movable through the operation of the motor 22 to drivingly operate the gear which meshes with the threaded portion 29 of the vertical post 306. The bracket 7 is mounted to the upper portion of the vertical post 306 by a selectively extendable and retractable pneumatic cylinder assembly 28 which selectively extends the bracket 7, in the direction of the arrow 17, in a direction opposite to the package transfer direction and retracts the bracket 7 in the package transfer direction. The bracket 7 supports a pair of vertically spaced horizontal rails 8, 9 fixed thereto.

The releasable engaging means includes a carriage 15 having a drive motor 16 and a carriage support assembly including four traveling rollers 135, 136, 137 and 138 (as shown in FIG. 6). Two of the traveling rollers 135 and 136 are constrained by the upper rail 8 for rolling travel therealong and the other two traveling rollers 137 and 138 are constrained by the lower rail 9 for rolling travel therealong. The drive motor 16 drives one of the lower traveling rollers 137, 138 to selectively move the carriage 15 in a direction generally transverse to the package transfer direction along the rails 8, 9. As best shown in FIG. 6, an arm 140 of the releasable engaging means is movably connected to a shaft 39 pivotally mounted to the carriage 15 and the other arm 141 of the releasable engaging means is movably connected to a shaft 40 pivotally mounted to the carriage 15. Each shaft 39, 40 has an arm extending radially therefrom and one end of a link 142, 143, is pivotally mounted to the free ends of the arms, respectively. The links 142, 143 are pivotally mounted, at their other ends, to a disk plate rotated by a motor 139 mounted in the carriage 15. A lead 133 operatively connects the motor 139 to the control device 330 of the traveling service unit 2. The free ends of the arms 140, 141 include horizontal tabs extending toward each other perpendicularly to the extent of the arms, compatibly configured to engage longitudinal slots 48, 49, respectively, in a pair of spaced apart engagement members 50, 51, which extend vertically and perpendicularly from the base 52 of each package support means 305, 305'.

The motor 16 of the carriage 15 is operatively connected by a lead 132 to the control device 330 of the service unit 2.

A sensor 31 mounted to the traveling service unit 2 is operatively connected via a lead 130 to a package counter 30 mounted in the traveling service unit 2. The counter 30 is operatively connected to the control device 330 and the counter counts the number of packages sensed by the sensor 31. The sensor 31 is mounted on the traveling service unit 2 at a location at which it can sense the number of packages loaded onto the package support means 305 when it is in the package receiving position.

Each package support means 305 is configured to support a predetermined number of packages loaded thereon such as, for example, a pair of packages. The sensor 31, which can be a conventional sensor which projects a photoelectric beam and emits a signal in response to interruption of the beam, provides a signal via the connector 130 to the counter 30 as the sensor senses a package disposed on the package support means 305 when it is in the package receiving position. The control unit 330, which receives data from the counter 30 relating the number of packages sensed by the sensor 31, can be configured to control the operation of the motor 22 and the motor 139, via the connector 122, to prevent lowering of the package support means 305 from tis package receiving position if the package support means has not received its full complement of packages. For example, if the sensor 31 senses that only a single packages. For example, if the sensor 31 senses that only a single package 14 has been disposed on the package support means 305, the control device 330 controls the motors 22,139, via the connector 122, to maintain the package support means 305 in its package receiving position vertically above the conveyor belts 23,23' until the second package 14' of the pair L of packages has been transferred to the package support means.

When the winding stations of a winding machine have completed their package building, those individual winding stations which have experienced a problem is building a package can be identified since the associated package support means 305 associated with the particular individual winding station will still remain in its package receiving position above the conveyors 23,23'. An operator can then remedy the problem at the individual winding station.

A sensor 32 mounting to the traveling service unit 2 monitors the condition of the package 14 being built at the winding station 301. The sensor 32 is operatively connected by a branch of the lead 122 to a solenoid 33 mounted on the traveling service unit 2. The solenoid 33 is mounted on the traveling service unit 2 at a location corresponding to the location of am microswitch 35 mounted to each winding station 301. The microswitches 35 are each individual connected to a disturbance indicator light 36 mounted at their associated winding station 301.

Figure 10:
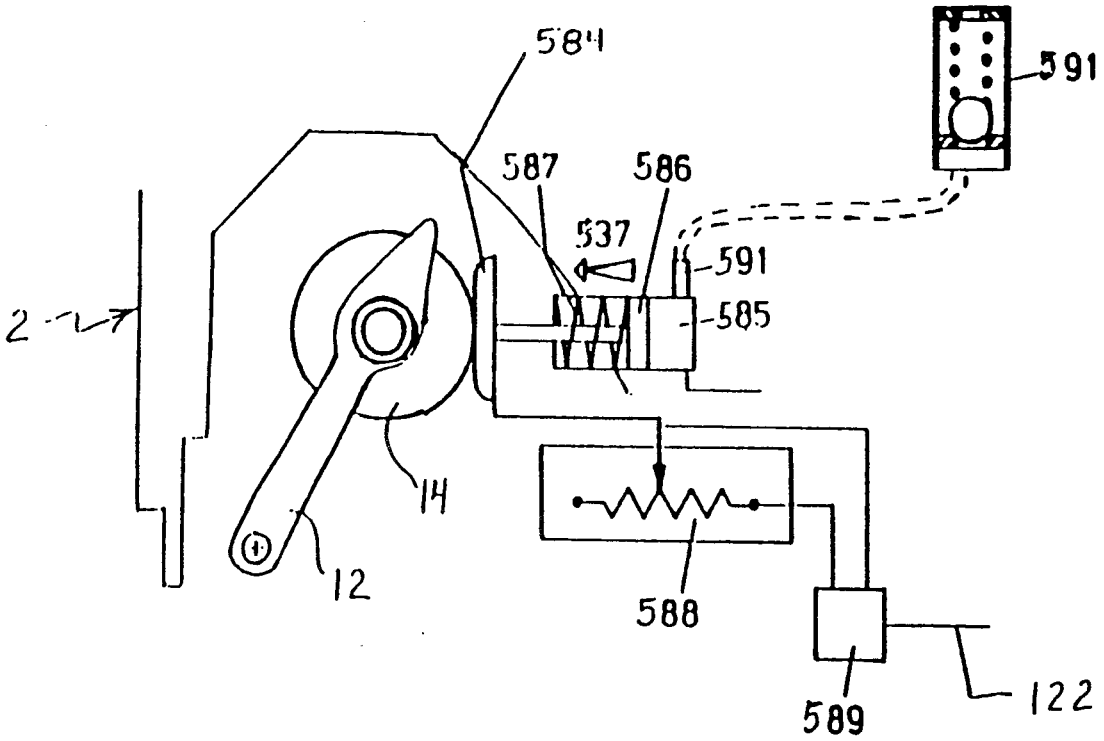
FIG. 10 is a side elevational view of one embodiment of a package condition sensor of the transport apparatus of the present invention.

The sensor 32 can be configured to monitor a condition such as the condition of the completion of building of the package. While the sensor 32 is illustrated in FIG. 1 as a conventional photoelectric-type sensor, FIG. 10 illustrates another possible configuration of a sensor for sensing the size of the package 14 built at a winding station. A sensor 583 includes a pneumatic cylinder and piston assembly 585 having a piston 584. The piston 584 has, at its free end, an enlarged, generally planar surface for tangentially engaging the circumferential surface of the package 14 being built at the winding station. The other end of the piston 584 includes an annular sealing disk 586 compatibly configured with the inner diameter of the cylinder of the pneumatic cylinder and piston assembly 585 for preventing the passage of pneumatic fluid therepast. A spring 587 disposed within the cylinder biases the enlarged, planar surface of the free end of the piston 584 in the direction opposite to an engagement direction 537 out of tangential engagement with the package 14.

The cylinder of the pneumatic cylinder and piston assembly 585 is operatively connected to a pneumatic fluid supply means 91 which continuously operates to supply pneumatic fluid into the cylinder of the pneumatic cylinder and piston assembly 585 to effect extension of the piston 584 against the bias of the spring 587 in the direction 537 into tangential engagement with the package 14. The free end of the piston 584 is operatively connected a potentiometer 588 and a converter 589. The converter 589 is operatively connected via a connector such as, for example, the connector 122, to the control unit 30.

As the package 14 is built, its effective diameter increases and the growing package continuously urges the piston 584 against the biasing force of the pneumatic fluid in the pneumatic cylinder and piston assembly 585 in a direction opposite to the direction 537. The potentiometer 585 supplies a signal to the converter 589 and the magnitude of the signal is responsive to the retraction movement of the piston 584. The converter 589, in turn, supplies a signal via the connector 122 to the control unit 30. The control unit 30 is preferably inputted with predetermined data relating to the desired fullness of the package 14 and the control unit 30 controls the winding station to cease building of the package 14 upon receipt of a signal from the converter 589 indicating that a package of the desired fullness or size has been completed.

In operation, the traveling service unit 2 is moved to one of the individual winding stations 301 to transfer a full cross-wound package 14 therefrom to a package support means 305 being held by the releasable engaging means of the present invention in the package receiving position. The traveling service unit 2 manipulates its carrier member 319, with the full cross-wound package 14 supported on the concave upper surface 320 thereof, to support the package immediately above the package support means 305, as shown in FIG. 3. Once the cross-wound package 14 is held by the carrier member 319 immediately above the base 52 of the support means 305, the carrier member 319 is manipulated to withdraw its upper concave surface 320 from under the package, thereby allowing the package to fall a relatively small distance under it sown weight onto the floor of the package support means 305.

Simultaneous with, or subsequent to, the transfer of the full cross-wound package 14 to the package support means 305, the traveling service unit 2 prepares the individual winding station 301 for winding another package by inserting a new tube onto the spindle 12 of the winding station.

After the traveling service unit 2 has prepared the individual winding station 301 to wind another package, the traveling service unit 2 travels to another location such as, for example, to another winding station, to perform a package transfer operation or a new tube insertion operation thereat. When the individual winding station 301 has completed the building of a second package, such as a full cross-wound package 14', the individual winding station signals the traveling service unit 2 to stop thereat to perform a package transfer operation.

Once another package has been built, such as a full cross-wound package 14', the service unit 2 is again operated to transfer the package to the package support means 305. As the package support means 305 already supports the full cross-wound package 14 thereon, the package support means 305 is moved in a direction transversely to the package transfer direction by operation of the drive motor 16 to move the carriage 15 along the rails 8, 9 to align the package support means for receipt of the second package from the winding station 301. The second full cross-wound package 14', which is of a different characteristic than the package 14 such as, for example, of a different amount of yarn, is disposed by the traveling service unit 2 in end-to-end relation with the package 14, as shown in FIG. 7, to form a plurality, such as a pair L, of packages ready for transport to the location for further handling or processing.

Thereafter, the package support means 305 is moved from the package receiving position in which it receives packages to the transport position in which it is placed on the conveyor belt 23. The movement of the package support means 305 between the package receiving position and the transport position occurs through controlled lowering of the vertical post 306.

Once the base 52 of the package support means 305 has been placed on the conveyor belt 23, the releasable engagable means is operated to release the arms 140, 141 from their engagement with the package support means 305. Specifically, the motor 139 is operated under control of the control device 330 to rotate the disk plate by an amount sufficient to cause the links 142, 143 to pivot their respective associated shafts 39, 40 so that the arms 140, 141 swing outwardly away from one another to thereby disengage the tabs of the arms from the longitudinal slots 48, 49 of the package support means 305.

Once the package support means 305, with the pair L of packages supported thereon, has been placed on the conveyor belt 23, the moving means E2 is operated to engage an empty package support means 305' which has been delivered to the winding station 301 on the conveyor belt 23'. Specifically, the vertical movement of the vertical post 306 and the retraction of the bracket 7 in the package transfer direction is coordinated by the control device 330 to position the arms 140, 141 in a position for engaging the longitudinal slots 48, 49 of the package support means 305'. Thereafter, the motor 139 is controlled by the control device 330 to pivot the arms 140, 141 toward one another to engage the longitudinal slots 48, 49 of the package support means 305'.

Once the package support means 305' has been engaged by the moving means E2, the moving means E2 is controlled by the control device 330 to move the package support means 305' to the package receiving position for receiving packages transferred thereto by the traveling service unit 2. Simultaneous with, or subsequent to, the movement of the moving means E2 to engage the package support means 305', the conveyor belt 23 is operated to transport the package support means 305 to the location for further handling or processing. The package support means 305' is held by the moving means E2 at a clearance from the transport device 304 such that the conveyor belt 23 can be operated to transport the package support means 305, with the pair L of packages thereon, past the package support means 305'.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

I claim:

1. In the operation of a textile machine of the type having a plurality of winding stations for building yarn packages and a package transporting device for transporting packages from the stations to a location for further handling or processing, a method comprising:

delivering plural package support means to the stations in condition for transferring packages thereto;

transferring a plurality of packages from said stations onto said package support means; and placing said package support means on said package transporting device for transporting said package support means, and packages supported thereon, from said stations to said location for further handling or processing.

2. In the operation of a textile machine, a method according to claim 1 and characterized further in that, in said transferring, a plurality of packages is transferred from one station to one of said package support means.

3. In the operation of a textile machine, a method according to claim 1 and characterized further in that, in said transferring, a plurality of packages having different characteristics from one another is transferred to each package support means.

4. In the operation of a textile machine, a method according to claim 1 and characterized further in that, in said transferring, packages of different amounts of yarn are transferred to each package support means.

5. In the operation of a textile machine, a method according to claim 1 and characterized further by positioning said package support means for transfer of packages thereto at a clearance from said package transporting device to permit transport therepast of other package support means on said package transporting device.

6. An apparatus for use in a textile machine of the type having a plurality of winding stations for building yarn packages and a package transporting device for transporting packages from the stations to a location for further handling or processing, comprising:

a plurality of package support means, each package support means being capable of supporting a plurality of packages thereon;

means for delivering said package support means to the stations in condition for transferring packages thereto;

means for transferring a plurality of packages from said stations onto each package support means; and means for placing said package support means on said package transporting device for transporting said package support means, with packages thereon, from said stations to said location for further handling or processing.

7. An apparatus according to claim 6 and characterized further in that said transferring means transfers a plurality of packages from one station to one of said package support means.

8. An apparatus according to claim 6 and characterized further by means for positioning said package support means for transfer of packages thereto at a clearance from said package transporting device to permit transport therepast of other package support means on said package transporting device.

9. An apparatus for use in a textile machine of the type having a plurality of winding stations for building yarn packages, a package transporting device for transporting packages from the stations to a location for further handling or processing and a package transfer device for transferring packages from the stations, comprising:

a plurality of package support means, each package support means being capable of supporting a plurality of packages thereon; and means for moving each said package support means between a package receiving position for transfer thereto of a plurality of packages by said transfer device and a transport position in which said package support means is placed on said device for transporting packages to the location for further handling or processing, said moving means including means for releasably engaging said package support means to support said package support means in said package receiving position and to release said package support means in said transport position.

10. An apparatus according to claim 9 characterized further in that said moving means includes means for manipulating said releasable engaging means for engaging another of said package support means for movement thereof between said package receiving position and said transport position.

11. An apparatus according to claim 9 and characterized further in that each of said package support means includes a pair of spaced apart engagement members and said moving means includes a carriage and a carriage support assembly, said carriage being movable along said carriage support assembly, and said releasable engaging means includes a pair of arms movably mounted to said carriage, said arms having free end portions engagable with said engagement members of said package support means for engagement of said package support means by said moving means, and selectively operable motor means, mounted on said carriage, for selectively moving said arms into and out of engagement with said engagement members of said package support means to selectively engage and release said package support means.

12. An apparatus according to claim 11 and characterized further in that said arms are pivotally mounted to said carriage, each said arm being pivotable between an engagement position in which it engages one of said engagement members of one of said package support means and a release position in which it releases said one package support means.

13. An apparatus according to claim 12 characterized further in that said moving means includes drive means, connected to said carriage, for selectively moving said carriage in a direction generally transverse to the transfer direction of said packages between the stations and said package support means for selectively repositioning said package support means for transfer of packages thereto from a plurality of said stations.

14. An apparatus according to claim 13 and characterized further in that said moving means includes support device for supporting said carriage support assembly above said device for transporting packages, said support device including a vertical post, means for selectively vertically moving said vertical post and a selectively extendable and retractable bracket mounted to said vertical post, said vertical post and said bracket cooperating together to move said arms between a position for engaging one of said package support means in condition for receipt of packages, a position for supporting said engaged package support means in said package receiving position and a position for releasing said engaged package support means, with packages supported thereon, onto said device for transporting packages.

15. An apparatus according to claim 14 and characterized further in that said device for transporting packages includes a pair of conveyor assemblies having conveyor belts, one conveyor assembly for delivering said package support means to the stations in condition for receipt of packages thereon and the other conveyor assembly for transporting said package support means to the location for further handling or processing.

16. An apparatus according to claim 15 and characterized further in that said conveyor belts of said conveyor assemblies travel generally parallel to one another.

* * * * *